US007724228B2

(12) United States Patent
Lee et al.

(10) Patent No.: US 7,724,228 B2
(45) Date of Patent: May 25, 2010

(54) LIQUID CRYSTAL DISPLAY DEVICE AND DRIVING METHOD THEREOF

(75) Inventors: Ju Young Lee, Gyeongsangbuk-do (KR); Jae Bum Chum, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1006 days.

(21) Appl. No.: 11/165,045

(22) Filed: Jun. 24, 2005

(65) Prior Publication Data

US 2006/0114207 A1 Jun. 1, 2006

(30) Foreign Application Priority Data

Nov. 29, 2004 (KR) ..... 10-2004-0098426

(51) Int. Cl.
*G09G 3/36* (2006.01)

(52) U.S. Cl. ..... 345/96; 345/88; 345/95

(58) Field of Classification Search ..... 345/54, 345/87, 88–89, 96, 204, 209, 212, 95; 348/674; 349/42

See application file for complete search history.

(56) References Cited

U.S. PATENT DOCUMENTS 4,720,708 A * 1/1988 Takeda et al. ..... 345/213
5,883,608 A * 3/1999 Hashimoto ..... 345/96
5,905,540 A * 5/1999 Miyashita et al. ..... 348/674
6,219,113 B1 * 4/2001 Takahara ..... 349/42
6,297,791 B1 * 10/2001 Naito et al. ..... 345/89
6,628,253 B1 * 9/2003 Hiroki ..... 345/87
2001/0000662 A1 * 5/2001 Hashimoto et al. ..... 345/96
2002/0140691 A1 * 10/2002 Sato et al. ..... 345/212
2003/0058229 A1 * 3/2003 Kawabe et al. ..... 345/204
2006/0114207 A1 * 6/2006 Lee et al. ..... 345/89

* cited by examiner

*Primary Examiner*—Chanh Nguyen
*Assistant Examiner*—Ram A Mistry
(74) *Attorney, Agent, or Firm*—McKenna Long & Aldridge LLP

(57) ABSTRACT

A display device including a liquid crystal display (LCD) device with an improved image quality is provided. The LCD includes a liquid crystal (LC) panel having horizontal lines and vertical lines arranged in a matrix configuration; a gate driver for supplying a scan signal to the horizontal lines; and a data driver inverting a polarity of interlace pixel data by a unit of at least two fields, converting the interlace pixel data every field according to a gamma voltage, and supplying the converted pixel data to the vertical lines.

3 Claims, 11 Drawing Sheets

LIQUID CRYSTAL DISPLAY DEVICE AND DRIVING METHOD THEREOF

This application claims the benefit of Korean Patent Application No. 2004-98426, filed on Nov. 29, 2004, which is hereby incorporated by reference for all purposes as if fully set forth herein.

BACKGROUND OF THE INVENTION

1. Field of the Invention

The present invention relates to a display device, and more particularly, to a liquid crystal display (LCD) device with improved image quality and driving method thereof.

2. Discussion of the Related Art

Flat display devices of lightweight and small volume are under development in order to replace cathode ray tubes (CRT). The flat display devices are classified into LCD devices, field emission displays (FED), plasma display panels (PDP), and electro-luminescence (EL) displays. The flat display devices display images on a display panel in accordance with video signals received from the outside.

Driving methods of the flat display devices are classified into the progressive type and the interlace type. The progressive-type driving method displays images on a frame basis, i.e., by a unit of image signals for one screen. Representative display devices using the progressive-type driving method are computer monitors, PDP, and LCD devices. For example, computer monitors uses image signals provided in the form of the progressive type. That is, the image signals of computer monitors are supplied on a frame basis. In the interlace-type driving method, image signals for one screen, i.e., one frame, are divided into image signals for an odd field and image signals for an even field and the image signals are displayed in order of the odd field and the even field. The representative display devices using this interlace-type driving method are televisions (TV). Televisions use image signals provided in the form of the interlace type. That is, image signals of one frame in TVs are divided into image signals for an odd field and image signals for an even field and supplied on a field basis.

An LCD device has a liquid crystal (LC) panel including pixels arranged in a matrix configuration for displaying images and a drive unit for driving the LC panel. The LC panel has horizontal lines and vertical lines, the pixels defined by the horizontal lines and the vertical lines, and pixel electrodes formed in the pixels. Also, red, green, and blue color filters are formed on the regions that correspond to the pixels. The drive unit includes a gate driver for sequentially supplying scan signals to the horizontal lines, a data driver for supplying predetermined image signals to the vertical lines, and a timing controller for generating control signals for controlling the gate driver and the data driver.

The horizontal lines are sequentially driven by the scan signals supplied from the gate driver and image signals supplied from the data driver are applied to the pixels via the vertical lines to display a predetermined image through the color filters. That is, the image signals for one frame are displayed in response to the sequentially driven horizontal lines. Therefore, the progressive-type driving method is appropriate for the LCD device having the horizontal lines sequentially operating. In other words, because the horizontal lines operate regardless of odd and even horizontal lines, the progressive type is appropriate for the LCD device.

Because image signals of the interlace type are supplied to an LCD-TV, the image signals cannot be properly displayed on the LCD-TV. To solve this problem, the image signals of the interlace type supplied to the LCD-TV are converted into image signals of the progressive type and the converted image signals are displayed on the LCD-TV. However, in such a case, because various devices (e.g., data converter, frame memory) for converting the image signals of the interlace type into the image signals of the progressive type are additionally required for the LCD-TV, the circuits of the LCD-TV becomes complicated and the manufacturing cost increases.

To solve this problem, a method of directly displaying image signals of the interlace type (interlace image signals) on an LCD device has been suggested without converting the interlace image signals into progressive image signals.

As described above, the interlace image signals are divided into the image signals for the odd fields and the image signals for the even fields and supplied to the LCD device. The odd fields have actual pixel data only on the odd horizontal lines and do not have actual pixel data on the even horizontal lines. In contrast, the even fields do not have actual pixel data on the odd horizontal lines but have actual pixel data only on the even horizontal lines. Therefore, the combination of the odd and even fields constitutes one complete frame.

When actual pixel data for odd fields are supplied, the LCD device generates dummy pixel data on the even horizontal lines on the basis of the actual pixel data existing on adjacent odd horizontal lines. Also, when actual pixel data for even fields are supplied, the LCD device generates dummy pixel data on the odd horizontal lines on the basis of the actual pixel data existing on adjacent even horizontal lines.

There are various methods of generating the dummy pixel data. The dummy pixel data are at least smaller than the actual pixel data. Because the actual pixel data exist on the odd horizontal lines of the odd fields and the dummy pixel data also exist on the even horizontal lines of the odd fields, each of the odd fields can constitute one complete frame. Also, because the dummy pixel data exist on the odd horizontal lines of the even fields and the actual pixel data exist on the even horizontal lines of the even fields, each of the even fields can constitute one complete frame.

The LCD device displays the first frame including the odd field by sequentially driving the respective gate lines and displays the second frame including the even field by driving the respective gate lines. Therefore, the LCD device can directly display the interlace image signals.

FIG. 1A is a schematic view illustrating interlace pixel data (interlace image signals) for an odd field supplied to an LC panel according to the related art and FIG. 1B is a schematic view illustrating interlace pixel data for an even field supplied to an LC panel according to the related art.

During the odd field period, actual pixel data are displayed on the odd horizontal lines and dummy pixel data are displayed on the even horizontal lines, as illustrated in FIG. 1A. In contrast, during the even field period, dummy pixel data are displayed on the odd horizontal lines and actual pixel data are displayed on the even horizontal lines, as illustrated in FIG. 1B. As described above, the dummy pixel data can be generated using the actual pixel data on adjacent horizontal lines.

Referring to FIG. 2, in order to improve the image quality of an LCD device, the polarity of the interlace image signals is generally inverted every field and the polarities of the image signals in one field are also configured in a dot-inversion method.

During the odd field (OF) period, actual pixel data having a positive polarity with respect to a common voltage Vcom are charged in predetermined pixels on the odd horizontal lines, while during the even field (EF) dummy pixel data having a negative polarity are charged in the pixels on the even horizontal lines, as illustrated in FIG. 3. The same pixel data may be charged in the respective pixels during the next OF and EF periods. As described above, the absolute values of the actual pixel data are much greater than the absolute values of the dummy pixel data. Accordingly, as the OF and EF periods are repeated, the average voltage (DC voltage) charged in the pixels has a positive polarity with respect to the common voltage Vcom, thereby generating a flicker and an afterimage defect.

To solve these problems, the polarity of the pixel data is inverted every other field (by a unit of two fields), as illustrated in FIG. 4. In detail, actual pixel data having a positive polarity with respect to the common voltage Vcom are charged in predetermined pixels on the odd horizontal lines during the first OF period and dummy pixel data having a positive polarity are charged in the pixels during the first EF period, as illustrated in FIG. 5. During the second OF period, actual pixel data having a negative polarity are charged in predetermined pixels on the odd horizontal lines and dummy pixel data having a negative polarity are charged in the pixels during the second EF period. Such a driving method is applicable to the next OF and EF periods in the same manner described above.

In the driving method described above, the positive actual pixel data charged during the first OF period and the positive dummy pixel data charged during the first EF period cancel out the polarity effects of the negative actual pixel data charged during the second OF period and the negative dummy pixel data charged during the second EF period. Accordingly, the average voltage (DC voltage) becomes almost zero, thereby preventing or minimizing the afterimage defect.

However, although the afterimage defect is prevented or minimized by inverting the polarity of the image signals every other field (by a unit of two fields), a flicker may occur. Referring to FIG. 6, actual pixel data having a positive polarity are charged in predetermined pixels on the horizontal lines during the OF period, dummy pixel data having a positive polarity are subsequently charged in the pixels during the EF period. In that case, because the pixels are charged with the same positive polarity during the OF and EF periods, not all of the actual pixel data charged during the OF period are discharged and some DC voltage remains. Therefore, the remaining DC voltage during the OF period is added to the dummy pixel data, so that dummy pixel data greater than the dummy pixel data are charged during the EF period. Such a process repeatedly occurs every EF period.

Accordingly, actual images are not displayed during the EF periods due to the influence of the remaining DC voltage, thereby generating a flicker. Such a flicker is particularly conspicuous, when pixel data having the same brightness are displayed. For example, when the pixel data of the first OF and the pixel data of the first EF have the same white value, the white color of the first OF is different from the white color of the first EF and a conspicuous flicker occurs due to the remaining DC voltage existing on the horizontal lines of the first OF.

SUMMARY OF THE INVENTION

Accordingly, the present invention is directed to a liquid crystal display (LCD) device with improved image quality and driving method thereof that substantially obviates one or more problems due to limitations and disadvantages of the related art.

An advantage of the present invention is to provide an LCD device with improved image quality and driving method thereof that can prevent or minimize an afterimage defect and a flicker.

Additional advantages and features of the invention will be set forth in part in the description which follows and in part will become apparent to those having ordinary skill in the art upon examination of the following or may be learned from practice of the invention. This and other advantages of the invention may be realized and attained by the structure particularly pointed out in the written description and claims hereof as well as the appended drawings.

To achieve these and other advantages and in accordance with the purpose of the invention, as embodied and broadly described herein, a liquid crystal display device includes a liquid crystal (LC) panel having horizontal lines and vertical lines arranged in a matrix configuration; a gate driver for supplying a scan signal to the horizontal lines; and a data driver inverting a polarity of interlace pixel data by a unit of at least two fields, converting the interlace pixel data every field according to a gamma voltage, and supplying the converted pixel data to the vertical lines.

In another aspect of the present invention, a method of driving a liquid crystal display device includes adding dummy pixel data to interlace pixel data every frame, each frame including an even field and an odd field; inverting a polarity of the interlace pixel data by a unit of two fields; converting the interlace pixel data every field according to a gamma voltage; and supplying the converted interlace pixel data to a liquid crystal (LC) panel.

In yet another aspect of the present invention, a display device includes a display panel having horizontal lines and vertical lines, the horizontal and vertical lines crossing each other to define a plurality of pixels; a gate driver for supplying a scan signal to the horizontal lines; a polar signal generator for outputting a first signal to invert a polarity of interlace pixel data by a unit of at least two fields; and a data driver converting the interlace pixel data every field according to a gamma voltage, and supplying the converted pixel data to the pixels via the vertical lines, wherein the gamma voltage varies in response to a second signal output from the polar signal generator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1A:
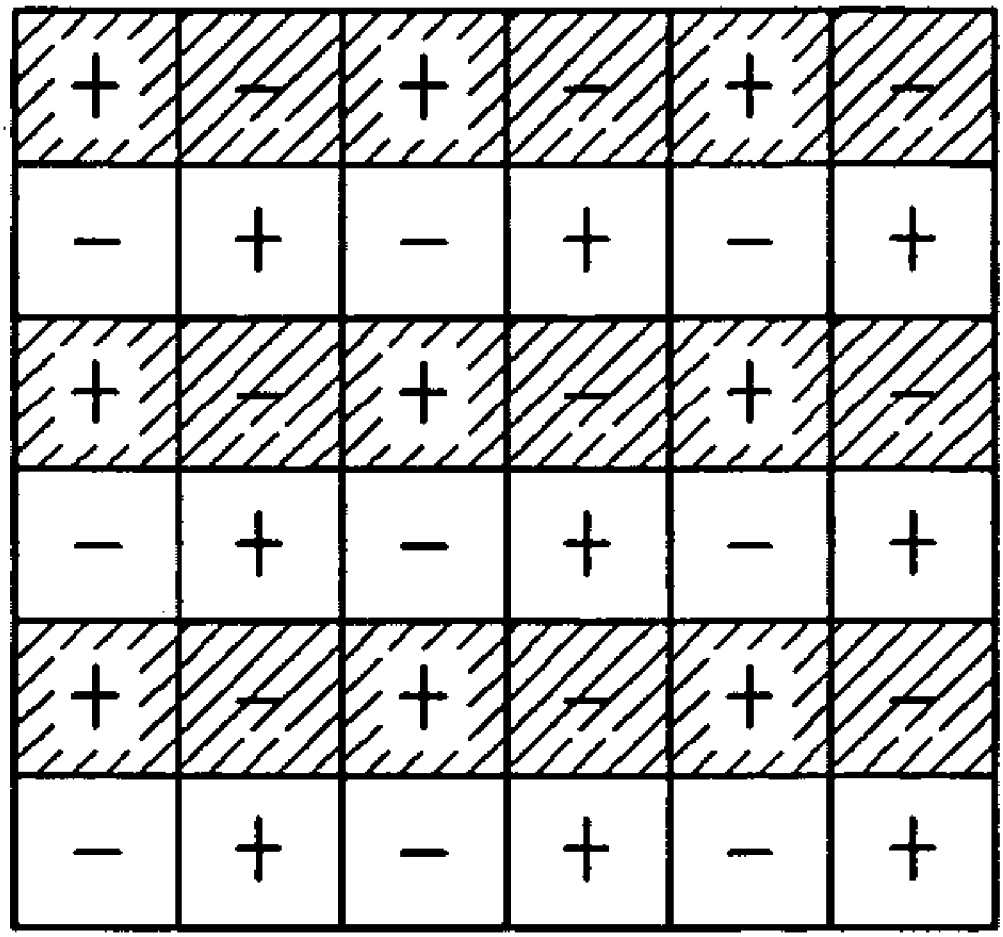
Fig. 1A Related Art
FIG. 1A is a schematic view illustrating interlace pixel data for an odd field supplied to an LC panel according to the related art.
Figure 1B:
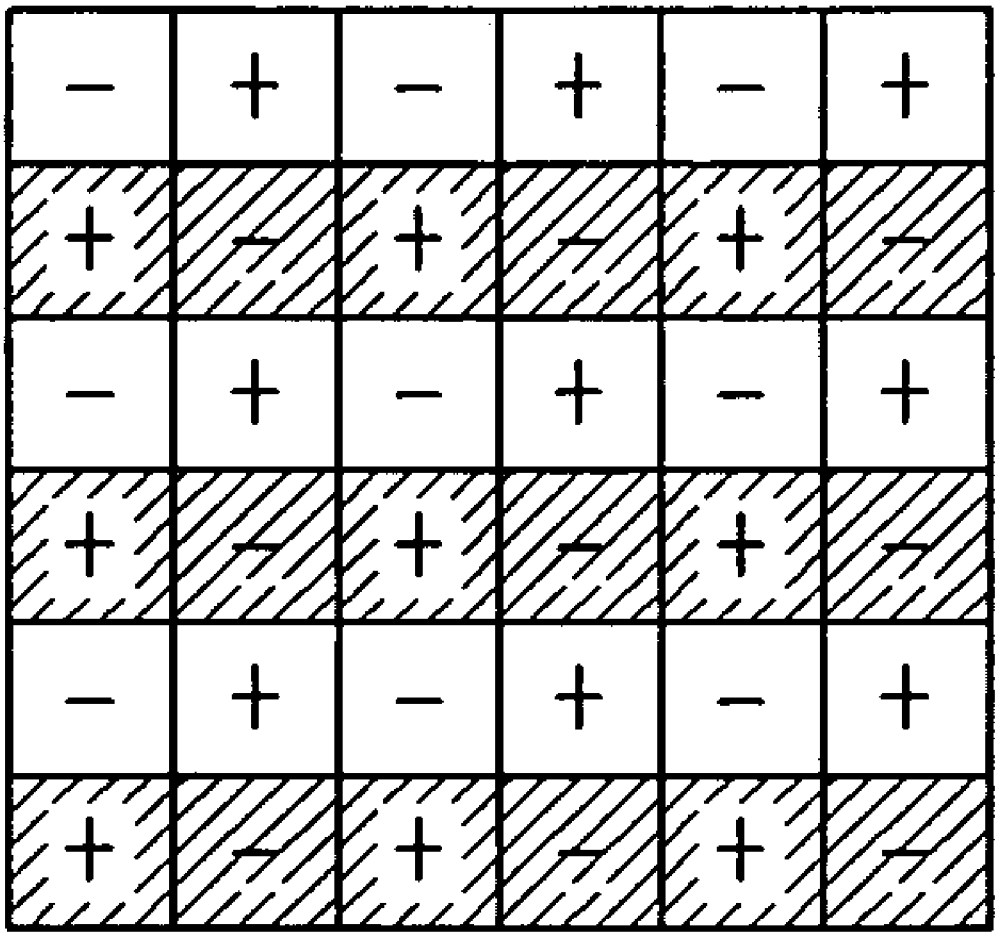
Fig. 1B Related Art
FIG. 1B is a schematic view illustrating interlace pixel data for an even field supplied to an LC panel according to the related art.
Figure 2:
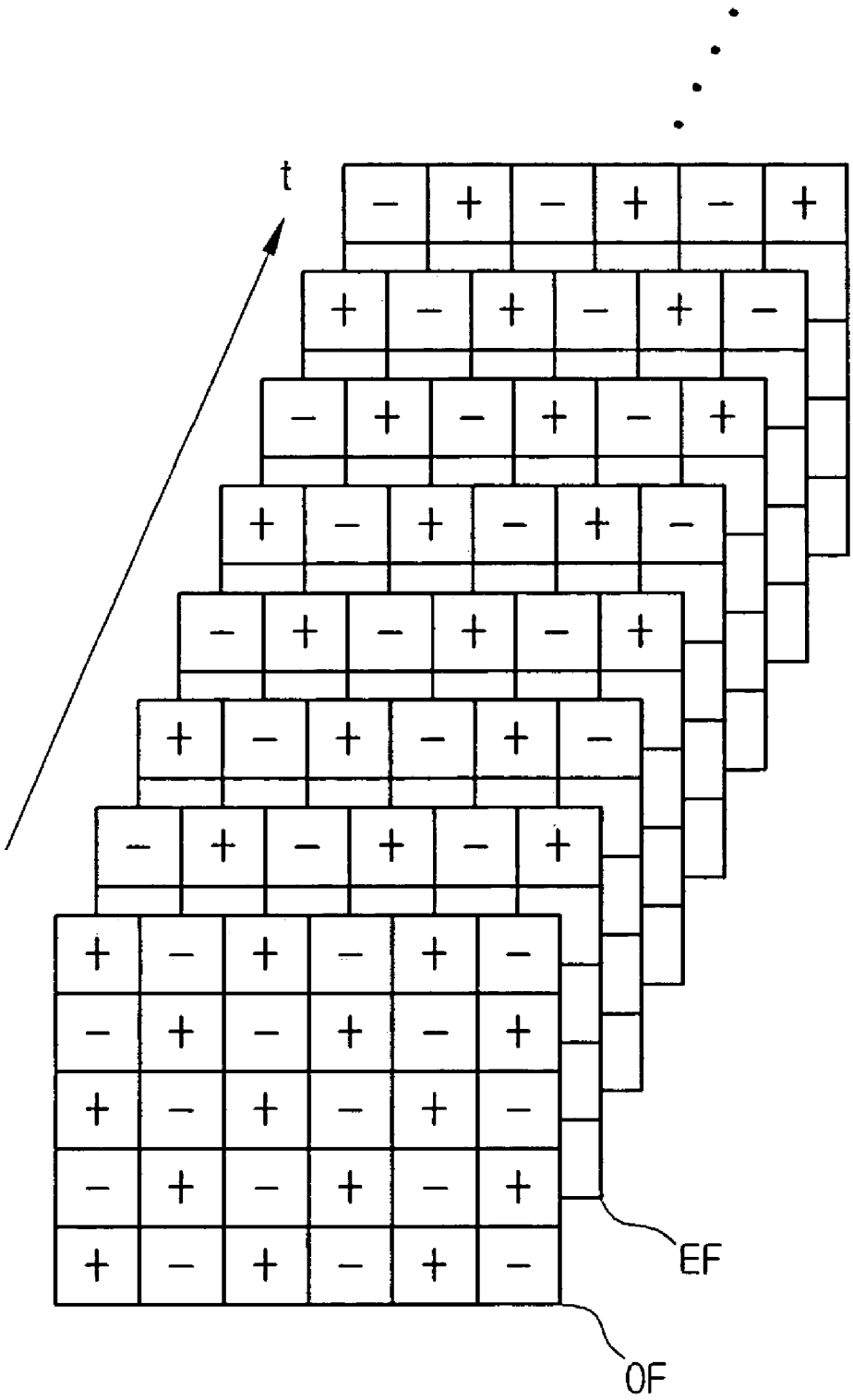
Fig.2 Related Art
FIG. 2 is a view illustrating interlace pixel data of each field according to the related art.
Figure 3:
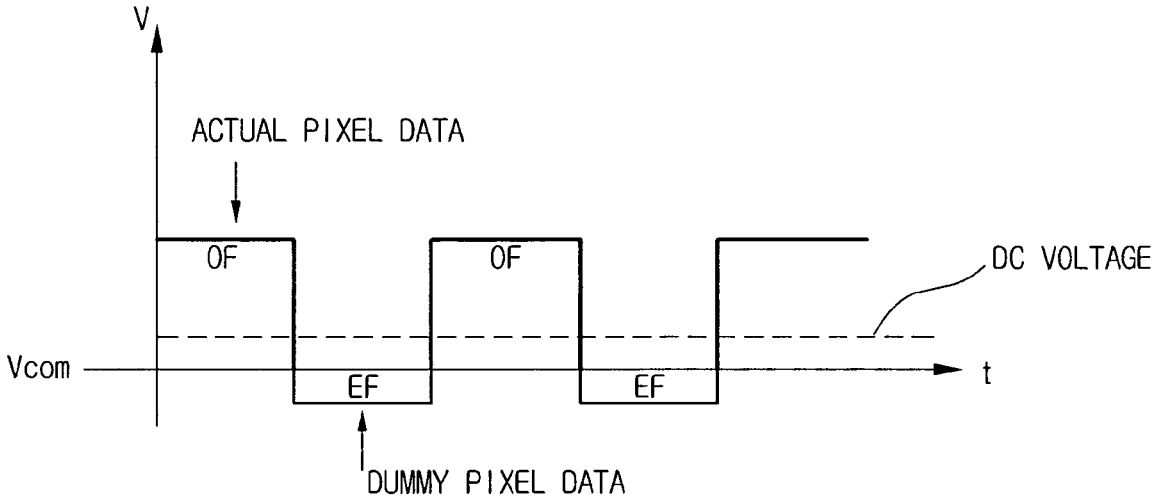
Fig.3 Related Art
FIG. 3 is a graph showing pixel data charged in one pixel on the odd horizontal lines illustrated in FIG. 4.
Figure 4:
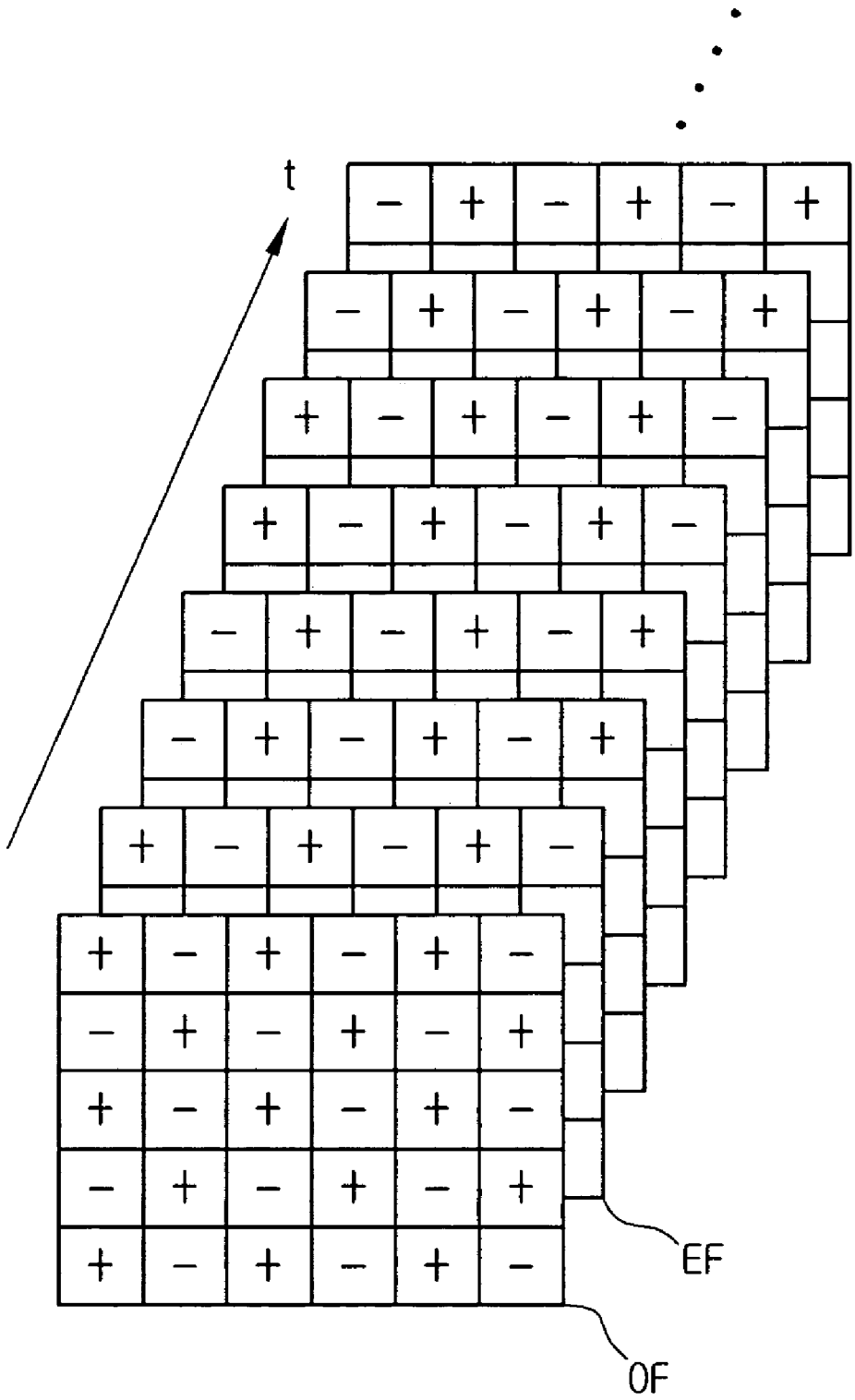
Fig.4 Related Art
FIG. 4 is a view illustrating interlace pixel data of each field according to the related art.
Figure 5:
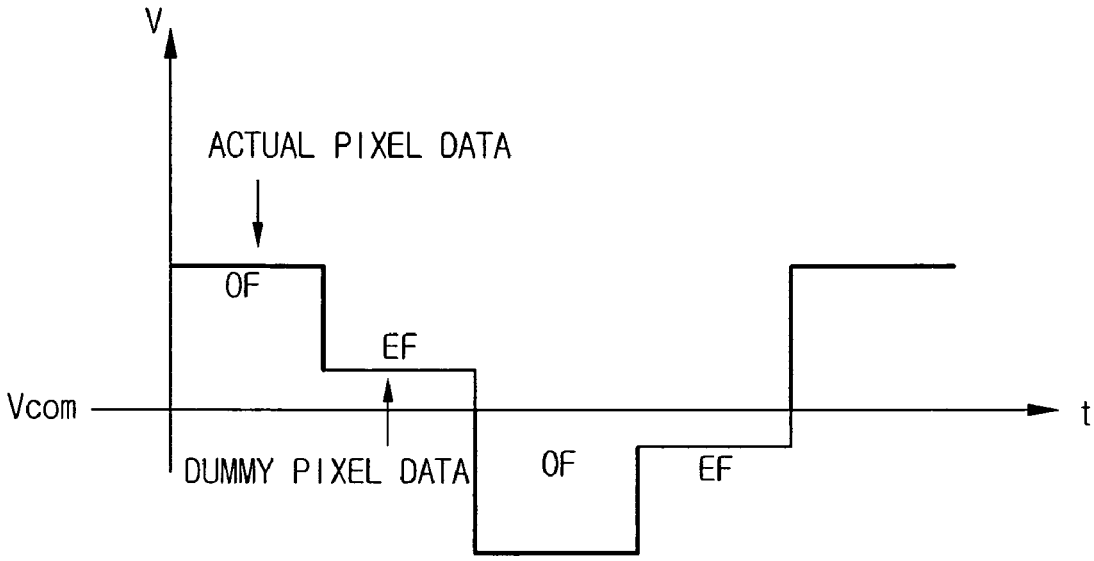
Fig.5 Related Art
FIG. 5 is a graph showing pixel data charged in one pixel on the odd horizontal lines illustrated in FIG. 4.
Figure 6:
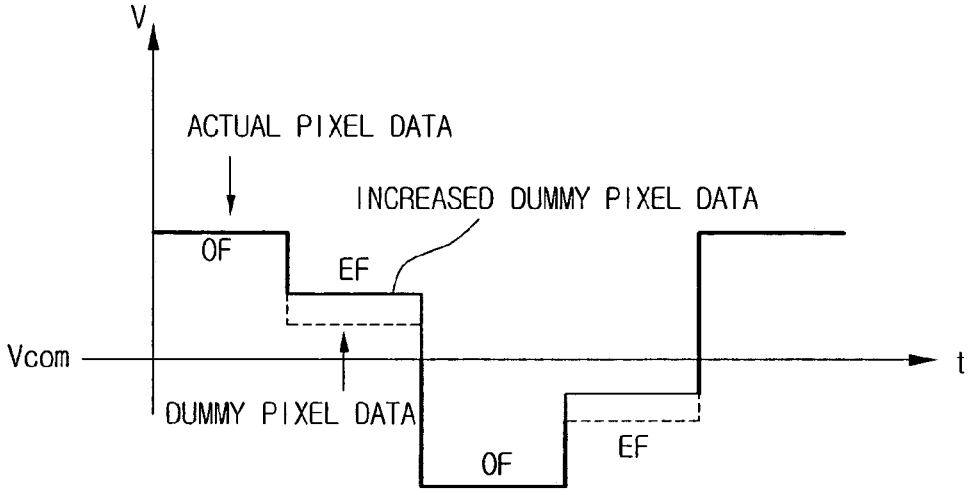
Fig.6 Related Art
FIG. 6 is a view explaining a flicker generation in the driving method illustrated FIG. 4.
Figure 7:
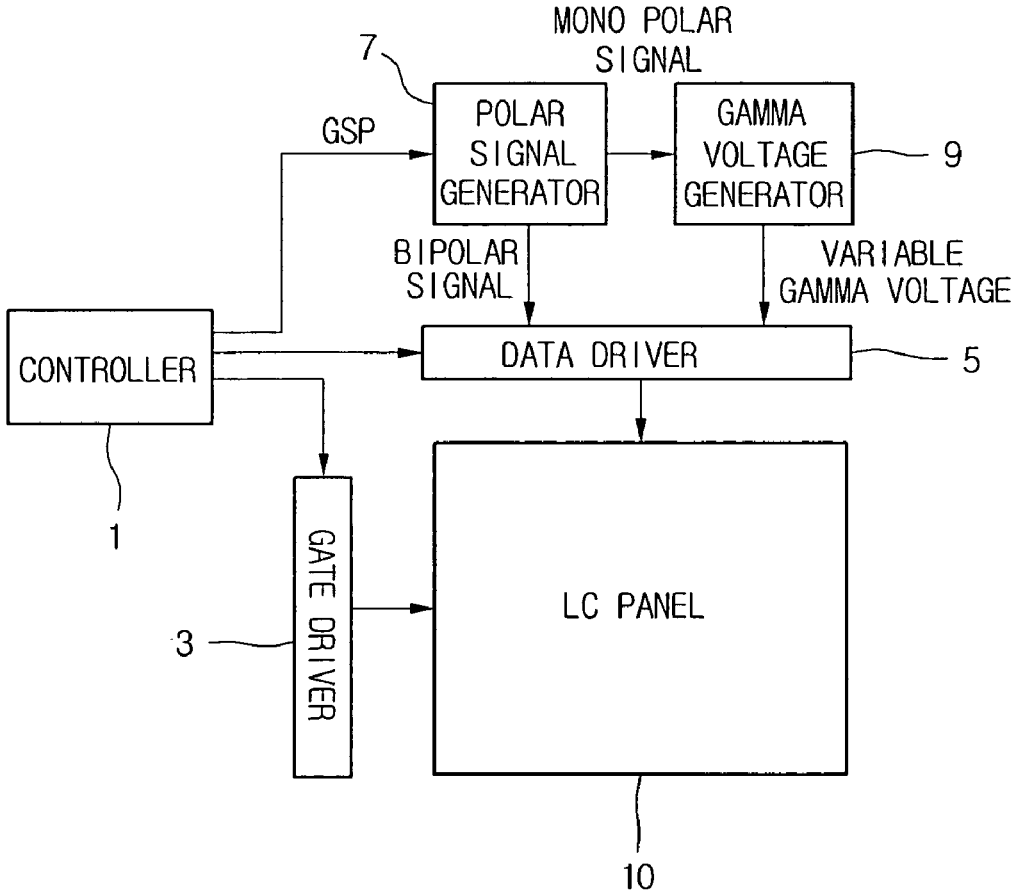
FIG. 7 is a block diagram of an LCD device according to an embodiment of the present invention.
Figure 8:
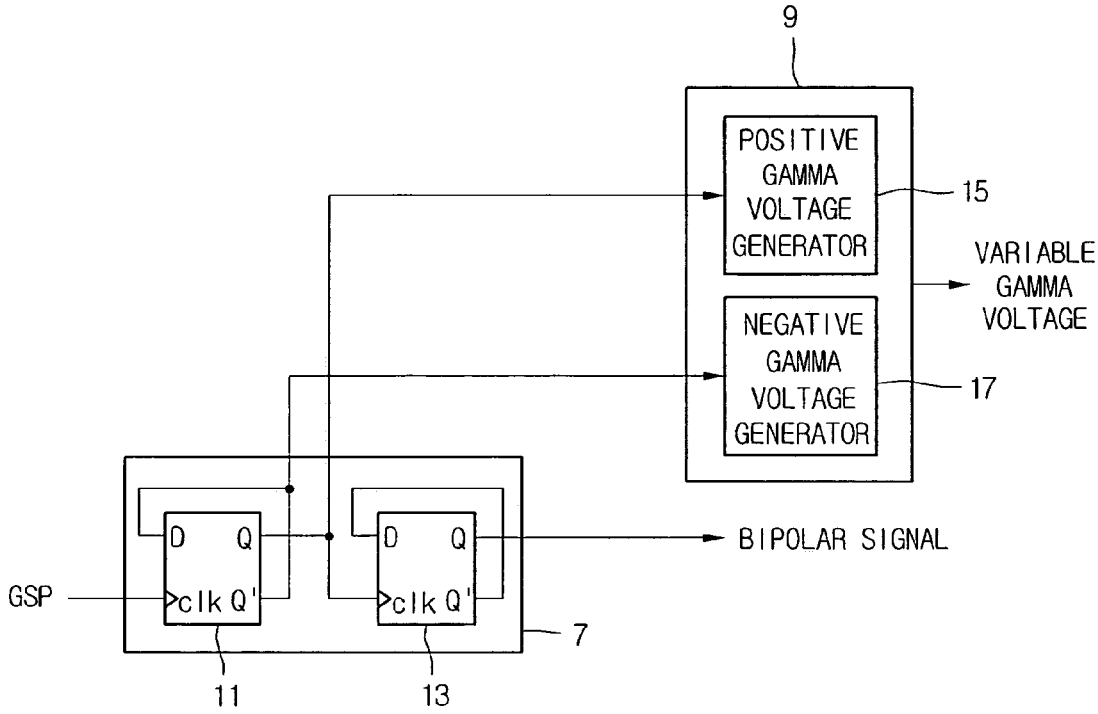
FIG. 8 illustrates the polar signal generator and gamma voltage generator illustrated in FIG. 7 in detail.

FIG. 7 is a block diagram of a liquid crystal display (LCD) device according to an embodiment of the present invention and FIG. 8 illustrates the polar signal generator and gamma voltage generator illustrated in FIG. 7 in detail.

Referring to FIG. 7, the LCD device includes a controller 1, a gate driver 3, a data driver 5, a polar signal generator 7, a gamma voltage generator 9 and an LC panel 10. The controller 1 receives interlace image signals including image signals for odd fields and image signals for even fields from an external graphic card (not shown) and generates dummy pixel data on even horizontal lines using actual pixel data on adjacent odd horizontal lines of the odd fields to form a set of image signals for one frame. Also, the controller 1 generates dummy pixel data on odd horizontal lines using actual pixel data on adjacent even horizontal lines of the even fields to form a set of image signals for one frame. That is, the controller 1 forms a set of image signals for one frame using the image signals of the odd field and also forms a set of image signals for another frame using the image signals of the even field. Of course, the combination of the image signals for the odd field and the image signals for the even field constitutes a set of image signals for one frame. In that case, the odd fields have actual pixel data only on the odd horizontal lines and do not have actual pixel data on the even horizontal lines. Also, the even fields have actual pixel data only on the even horizontal lines and do not have actual pixel data on the odd horizontal lines.

As described above, in order to directly display interlace image signals on an LCD device that sequentially or progressively scans the horizontal lines, the controller 1 generates dummy pixel data that do not contain actual pixel data for the even horizontal lines during the odd fields and dummy pixel data that do not contain actual pixel data for the odd horizontal lines during the even fields. By doing so, the controller 1 provides pixel data to all of the horizontal lines to allow the pixel data to be sequentially displayed on the LCD device.

The controller 1 generates the first control signals GSP, GSC, and GOE and the second control signals SSP, SSC, and SOE for driving the gate driver 3 and the data driver 5, respectively. The first control signals are supplied to the gate driver 3 and the second control signals and the converted pixel data are supplied to the data driver 5. The gate driver 3 sequentially supplies scan signals to the LC panel 10 in response to the first control signals.

According to an embodiment of the present invention, a polarity of pixel data is converted by a unit of two fields (odd field and even field). To this end, the polar signal generator 7 generates a bipolar signal and provides the bipolar signal to the data driver 5. The polar signal generator 7 includes a first D flip-flop 11 and a second D flip-flop 13 connected with the first D flip-flop 11.

Referring to FIG. 8, the first D flip-flop outputs a value of an input terminal D through a non-inverting terminal Q in response to a GSP signal. The GSP signals can be repeatedly generated from the controller 1 by a unit of one field (even field or odd field). The second D flip-flop 13 outputs a value of an input terminal D through a non-inverting terminal Q in response to a value output through the non-inverting terminal Q of the first D flip-flop 11. When the non-inverting terminal Q outputs a high voltage, an inverting terminal Q' outputs a low voltage. Therefore, the non-inverting terminal Q and the inverting terminal Q' always output opposite voltages.

Figure 9:
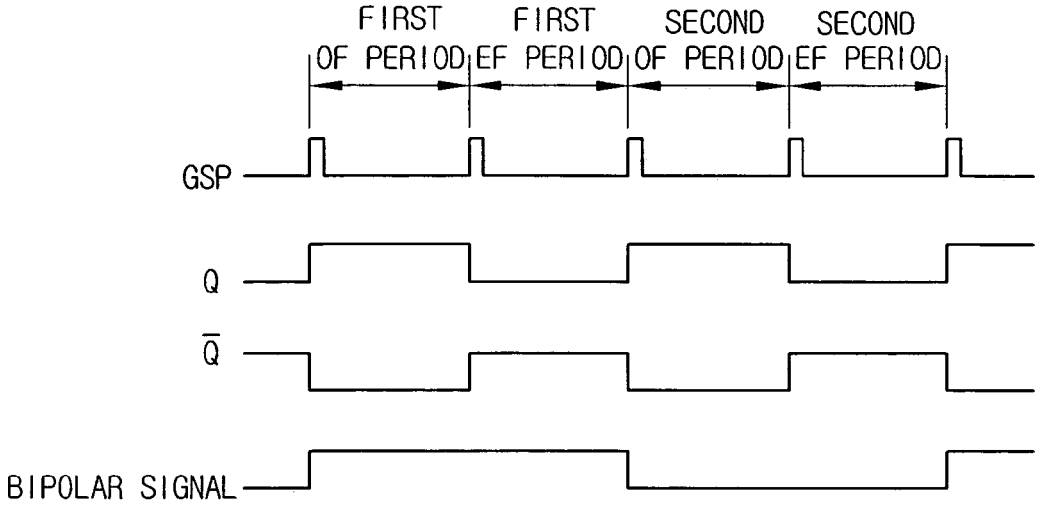
FIG. 9 is a waveform diagram of an embodiment of the present invention.

An operation of the polar signal generator 7 and gamma voltage generator 9 will be described in detail with reference to FIGS. 8 and 9. First, the first GSP signal is input to the first D flip-flop 11. At this point, when a high voltage is applied to the inverting terminal Q' of the first D flip-flop 11, the first D flip-flop 11 outputs a high voltage in response to the first GSP signal. The high voltage is then input to a clock (clk) terminal of the second D flip-flop 13. At this point, when a high voltage is applied to the inverting terminal Q' of the second D flip-flop 13, the second D flip-flop 13 outputs a high voltage in response to the high voltage output from the first D flip-flop 11. Also, the first D flip-flop 11 outputs a low voltage output from the inverting terminal Q' of the first D flip-flop 11 in response to the second GSP signal. Because the second D flip-flop 13 does not operate due to the above-output low voltage, the non-inverting terminal Q of the second D flip-flop 13 constantly outputs the previous high voltage.

The first D flip-flop 11 outputs a high voltage, which is an output of the inverting terminal Q', in response to the third GSP signal, and the second D flip-flop 13 outputs a low voltage, which is an output of the inverting terminal Q', in response to the above-output high voltage. The first D flip-flop 11 outputs a low voltage, which is an output of the inverting terminal Q', in response to the fourth GSP signal, and the second D flip-flop 13 does not operate due to the above-output low voltage and constantly outputs the previous low voltage.

Therefore, the polar signal generator 7 generates a bipolar signal for inverting polarity by a unit of two fields to supply the signal to the data driver 5. At this point, the non-inverting terminal Q and the inverting terminal Q' of the first D flip-flop 11 generate a unipolar signal for inverting polarity by a unit of one field to supply the signal to the gamma voltage generator 9. The polar signal has a value between 0V and several V. That is, when the polar signal has a low voltage, it can be 0V and when the polar signal has a high voltage, it can be several V.

The gamma voltage generator 9 has a positive polar gamma voltage generator 15 and a negative polar gamma voltage generator 17. The positive polar gamma voltage generator 15 is used when positive polar pixel data are supplied to the LC panel 10 and the negative polar gamma voltage generator 17 is used when negative polar pixel data are supplied to the LC panel 10. The polarity of the pixel data is inverted by a unit of two fields according to the bipolar signal generated from the polar signal generator.

For example, the positive polar pixel data is supplied to the LC panel 10 for the first odd and even field periods and the negative polar pixel data is supplied to the LC panel 10 for the second odd and even field periods. Therefore, the pixel data is gamma-converted according to a gamma voltage generated from the positive gamma voltage generator for the first odd and even field periods. Also, the pixel data is gamma-converted according to a gamma voltage generated from the negative gamma voltage generator for the second odd and even field periods.

That is, the data driver 5 inverts the polarity of the pixel data supplied from the controller 1 by a unit of two fields (odd field and even field) according to the bipolar signal generated from the polar signal generator 7. Also, the data driver 5 gamma-converts the polarity-inverted pixel data by reflecting the gamma voltage generated from the gamma voltage generator 9 according to the polarity thereof and supplies the gamma-converted pixel data to the LC panel 10.

The LC panel 10 has the first substrate and the second substrate and an LC layer provided between the first and second substrates.

A general TN-mode LC panel will be described. The first substrate includes horizontal lines and vertical lines perpendicularly crossing each other. TFTs are connected with the horizontal lines and pixel electrodes are connected with the TFTs. Pixels are defined by the horizontal lines and the vertical lines. One pixel includes one TFT and one pixel electrode.

The second substrate has red, green, and yellow color filters formed on the regions that correspond to the pixels, a black matrix formed between the respective color filters, a common electrode formed on the color filters and the black matrix for supplying a common voltage. The present invention can be applied to other mode LC panels as well as the TN mode LC panel.

As described above, the first D flip-flop 11 of the polar signal generator 7 generates a unipolar signal for inverting polarity by a unit of one field. That is, a high voltage is output for the first odd field, a low voltage is output for the first even field, a high voltage is output for the second odd field, and a low voltage is output for the second even field from the inverting terminal Q' of the first D flip-flop 11. The non-inverting terminal Q of the first D flip-flop 11 can output a voltage opposite an output of the inverting terminal Q'. For example, when the output of the non-inverting terminal Q is a high voltage, the output of the inverting terminal Q' can be a low voltage.

A voltage output from the polar signal generator 7 is supplied to the gamma voltage generator 9. That is, referring to FIG. 8, a unipolar signal output from the non-inverting terminal Q of the first D flip-flop 11 of the polar signal generator 7 can be supplied to the positive gamma voltage generator 15 of the gamma voltage generator 9 and a unipolar signal output from the inverting terminal Q' of the first D flip-flop 11 can be supplied to the negative gamma voltage generator 17 of the gamma voltage generator 9. Also, the opposite case is possible.

The positive gamma voltage generator 15 changes a gamma voltage using a unipolar signal output from the non-inverting terminal Q of the first D flip-flop 11. Therefore, the gamma voltage can be changed as much as a voltage range of the unipolar signal. For example, the gamma voltage can be increased as much as a high voltage when the unipolar signal has the high voltage. Further, the gamma voltage can be decreased as much as a low voltage when the unipolar signal is the low voltage. Therefore, because the unipolar signal is converted from a high voltage to a low voltage every field, the gamma voltage can be increased as much as a high voltage and decreased as much as a low voltage by a unit of one field. For example, the positive gamma voltage generator 15 can output a gamma voltage increased as much as a high voltage for the first odd field and can output a gamma voltage decreased as much as a low voltage for the first even field.

Figure 10:
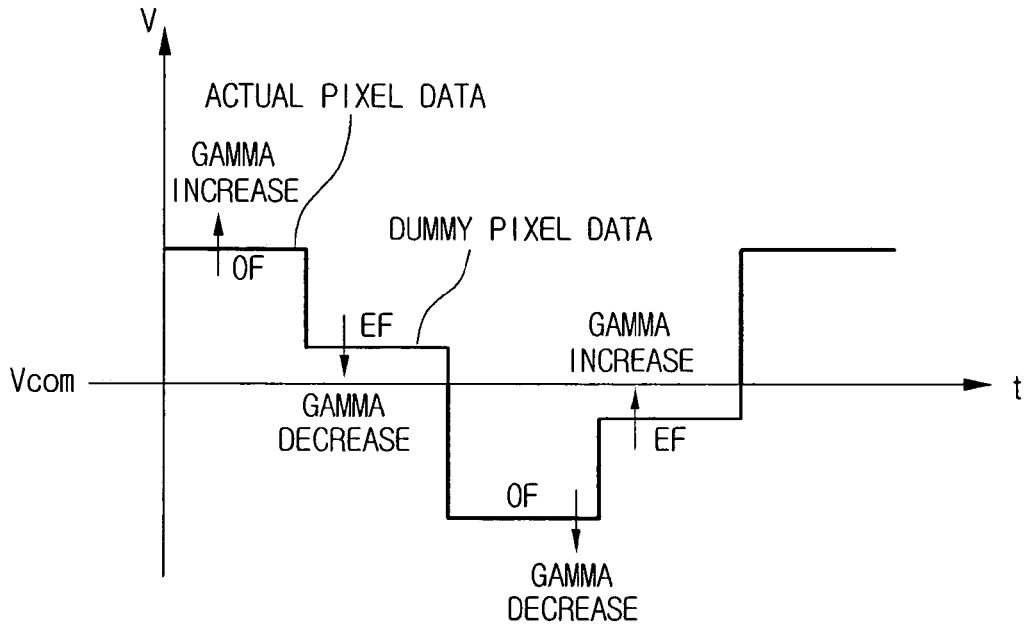
FIG. 10 is a graph showing pixel data charged in one pixel in an embodiment of the present invention.

Referring to FIG. 10, the pixel data for the first odd and even fields have the same positive polarity and the pixel data for the second odd and even fields have the same negative polarity. The data driver 5 gamma-converts the pixel data according to the gamma voltage increased as much as a high voltage for the first odd field and gamma-converts the pixel data according to the gamma voltage decreased as much as a low voltage for the first even field period. The above gamma-converted pixel data are supplied to the LC panel 10 by a unit of one field. Therefore, the pixel data are increased compared with the actual pixel data for the first odd field and decreased compared with the actual pixel data for the first even field, thereby preventing or minimizing an increase of the pixel data of the first even field due to a remaining DC current generated during the first odd field period and the flicker associated with the increase of the pixel data of the first even field.

Also, the data driver 5 gamma-converts the pixel data according to the gamma voltage increased in a negative direction as much as a high voltage for the second odd field and gamma-converts the pixel data according to the gamma voltage decreased as much as a low voltage for the second even field. The above gamma-converted pixel data are supplied to the LC panel 10 by a unit of one field. Therefore, the pixel data are increased compared with the actual pixel data for the second odd field and decreased compared with the actual pixel data for the second even field, thereby preventing or minimizing an increase of the pixel data of the second even field due to a remaining DC current generated during the second odd field period and the flicker associated with the increase of the pixel data of the second even field.

The present invention can prevent or minimize a flicker by reflecting the increased gamma voltage to the pixel data for the odd field and reflecting the decreased gamma voltage to the pixel data for the even field, wherein the pixel data of the odd field has the same polarity as the pixel data of the even field. As a result, an LCD device according to the present invention displays images with a high quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A liquid crystal display device comprising:

a liquid crystal panel having horizontal lines and vertical lines arranged in a matrix configuration;

a controller for receiving interlace pixel data every frame and generating a control signal including a gate shift pulse signal, each frame including an odd field and an even field, and dummy pixel data being generated from the interlace pixel data at each field;

a polar signal generator for generating a unipolar signal and a bipolar signal in response to the gate shift pulse signal, the unipolar signal having one of a low voltage and a high voltage at each field, and a polarity of the bipolar signal being inverted by a unit of at least two fields;

a gamma voltage generator for changing positive and negative gamma voltages that have different value using the unipolar signal at each field, the positive and negative gamma voltage each increasing as much as a high voltage of the unipolar signal for an odd field and decreasing as much as a low voltage of the unipolar signal for an even field;

a gate driver for supplying a scan signal to the horizontal lines; and a data driver for inverting polarities of the interlace pixel data and the dummy pixel data by the unit of at least two fields according to the bipolar signal, converting the interlace pixel data and the dummy pixel data into the changed positive gamma voltage or the changed negative gamma voltage from the gamma voltage generator for at least two fields, and supplying the changed gamma voltage to the vertical lines, wherein the data driver gamma-converts the interlace pixel data according to the gamma voltage increases as much as the high voltage for the odd field and gamma-converts the dummy pixel data according to the gamma voltage decreases as much as the low voltage for the even field, wherein the gamma voltage generator includes a positive polar gamma voltage generator and a negative polar gamma voltage generator, wherein the positive gamma voltage generator changes the positive gamma voltage using the unipolar signal at each field, the positive gamma voltage increasing as much as a high voltage when the unipolar signal has the high voltage for the odd field and decreasing as much as a low voltage when the unipolar signal has the low voltage for the even field, wherein the negative gamma voltage generator changes the negative gamma voltage using the unipolar signal at each field, the negative gamma voltage increasing as much as a high voltage when the unipolar signal has the high voltage for the odd field and decreasing as much as a low voltage when the unipolar signal has the low voltage for the even field.

2. A method of driving a liquid crystal display device comprising:

receiving interlace pixel data every frame, each frame including an odd field and an even field;

generating a control signal including a gate shift pulse signal;

generating dummy pixel data from the interlace pixel data at each field;

generating a unipolar signal and a bipolar signal in response to the gate shift pulse signal, the unipolar signal having one of a low voltage and a high voltage at each field, and a polarity of the bipolar signal being inverted by a unit of at least two fields;

changing positive and negative gamma voltages that have different value using the unipolar signal at each field, the positive and negative gamma voltage each increasing as much as a high voltage of the unipolar signal for an odd field and decreasing as much as a low voltage of the unipolar signal for an even field;

inverting polarities of the interlace pixel data and the dummy pixel data by the unit of at least two fields according to the bipolar signal;

converting the interlace pixel data and the dummy pixel data into the changed positive gamma voltage or the changed negative gamma voltage for at least two fields; and supplying the changed gamma voltage to a liquid crystal panel, wherein the gamma voltage increases as much as a high voltage is output for the odd field and the gamma voltage decreases as much as a low voltage is output for the even field, wherein the positive gamma voltage increases as much as a high voltage when the unipolar signal has the high voltage for said interlace pixel data of the odd field and decreases as much as a low voltage when the unipolar signal has the low voltage for said dummy pixel data of the even field, wherein the negative gamma voltage increases as much as a high voltage when the unipolar signal has the high voltage for said interlace pixel data of the odd field and decreases as much as a low voltage when the unipolar signal has the low voltage for said dummy pixel data of the even field.

3. The method according to claim 2, wherein the interlace pixel data and the dummy pixel data of the odd field is converted into the gamma voltage increases as much as a high voltage of the unipolar signal and the interlace pixel data and the dummy pixel data of the even field is converted into the gamma voltage decreases as much as a low voltage of the unipolar signal.

* * * * *